US006311333B1

(12) United States Patent
Batra

(10) Patent No.: US 6,311,333 B1
(45) Date of Patent: Nov. 6, 2001

(54) INVISIBLE STRETCH GARMENT

(75) Inventor: Sachin Batra, Stamford, CT (US)

(73) Assignee: Union Underwear Company, Inc., Bowling Green, KY (US)

( * ) Notice: Subject to any disclaimer, the term of this patent is extended or adjusted under 35 U.S.C. 154(b) by 0 days.

(21) Appl. No.: 09/635,020

(22) Filed: Aug. 4, 2000

Related U.S. Application Data

(60) Provisional application No. 60/147,447, filed on Aug. 5, 1999.

(51) Int. Cl.[7] ..... A41D 1/00

(52) U.S. Cl. ..... 2/237; 2/227; 2/221

(58) Field of Search ..... 2/227, 228, 236, 2/237, 238, 79, 69, DIG. 4, 401, 211, 214, 220, 221, 80, 75, 78.3, 122

(56) References Cited

U.S. PATENT DOCUMENTS

| | | |
|---|---|---|
| 264,249 | 9/1882 | David . |
| 1,149,271 | 8/1915 | Lazarus . |
| 1,744,695 | 1/1930 | Fishback et al. . |
| 1,797,115 | 3/1931 | Atkinson . |
| 1,812,593 | 6/1931 | Karberg . |
| 2,415,857 | 3/1947 | Trinkel . |
| 3,220,017 | 11/1965 | Morton . |
| 3,435,462 | 4/1969 | Bank . |
| 4,843,654 | 7/1989 | March . |
| 4,890,337 | 1/1990 | Greengberg . |
| 5,535,451 | 7/1996 | Tassone et al. . |

*Primary Examiner*—Gloria M. Hale
(74) *Attorney, Agent, or Firm*—John F. Salazar; Middleton Reutlinger

(57) ABSTRACT

The present invention is directed towards a pant garment such as a standard jean wherein the level of comfort in the jean is increased by incorporating a stretchable material in particular sections of the garment construct. Thus, the majority of the jean or pant garment may be made of standard rigid denim or the like material but the yoke and the rear section of the waistband may incorporate a stretchable quality. This material is designed to be visually indistinguishable from the other non-stretch material of the garment.

8 Claims, 4 Drawing Sheets

INVISIBLE STRETCH GARMENT

This application claims priority to provisional application number 60/147,447 filed Aug. 5, 1999.

BACKGROUND OF THE INVENTION

1. Technical Field of the Invention

The present invention relates to pant garments and in particular pant garments which have the ability to stretch yet which provide a normal fabric appearance.

2. Description of the Related Art

It is well-known in the prior art to provide elastic material in specific areas of garments to provide flexibility therein. Such elastic material has been placed in various areas of the pants to provide such flexibility, such as in the waistband. However, such placement of elastic material is done in a manner in which it is clearly visible and apparent that the garment is made of partial elastic material or elastic interwoven material. Prior art elastic material utilized in garment construction oftentimes causes gathering of the material around the elastic construction making it apparent that elastic and stretchable material is being utilized to ease the fit for the wearer. U.S. Pat. No. 4,890,337 discloses use of a stretchable and expandable waistband of a similar nature. However, upon actual stretching of the stretchable waistband, it is visibly apparent that the garment is stretching and that extra material is required for comfort fit of the wearer.

U.S. Pat. No. 3,220,017 discloses an additional construction of stretchable trouser construction wherein the waist band has areas of elastic material incorporated therein in the direction of its length. Additionally, the upper portion of the pockets are also constructed of an elastic material. However, the elastic material is easily visible and differentiated from the standard material utilized in the remaining portion of the trouser and can cause gathering and other unsightly fabric constructions.

SUMMARY OF THE INVENTION

It is therefor one object of the present invention to provide a garment which overcomes the above mentioned problems and which provides an invisible stretch capability. It is a further object of the present invention to provide a pant garment which has the look or appearance of a standard cotton or singular fabric piece but which actually contains some type of stretching ability.

It is a further object of the present invention to provide a pant which has a higher level of comfort for the wearer but which has the appearance of a standard jean or other garment material. Further, an object of the present invention is to expand use of such a construction to be applicable to any style in any woven fabric.

These and other objects are met by the present invention which provides for a stretch fabrication of material strategically placed within the pant to provide expansion or stretching in those areas but which provides the appearance of a single fabric construction. The major portion of the garment is comprised of standard non-stretch denim or similar material in addition to a stretch fabric which is placed in particular areas in the waistband and in the rear yoke area of the pant.

In accordance with the present invention, there is provided a pant garment which is primarily constructed of standard denim or other similar fabric. In order to provide the garment with the ability to stretch or flex in specific areas, a stretchable material is provided which is of the same color and construction type as the major portion of the garment. This stretchable material is distinctly placed within the rear portion of the waistband and the yoke area of the rear end. The pant construction of the present invention provides a stretch function in the rear portion without any visible construction change.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
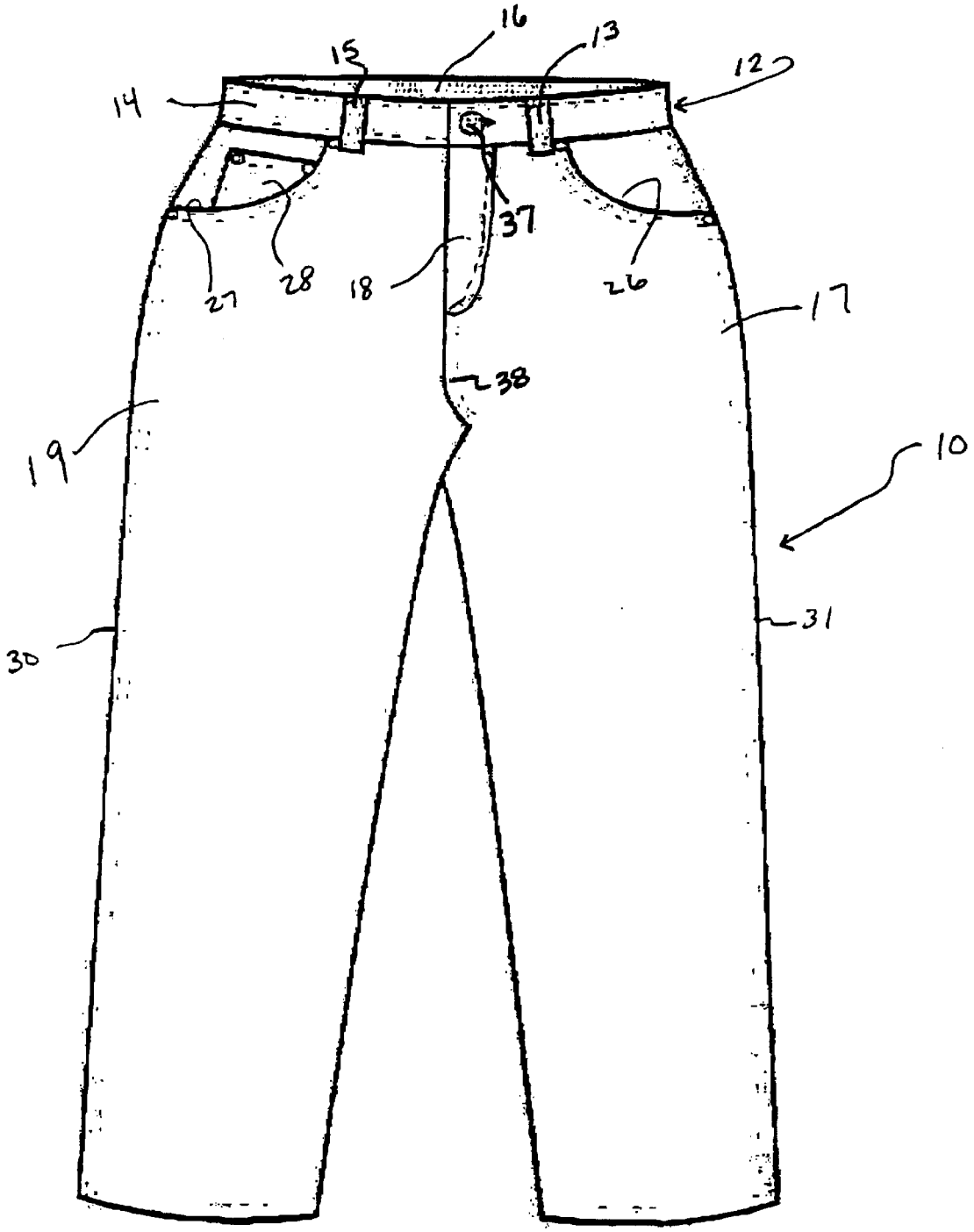
FIG. 1 is a front view of the garment of the present invention.

With reference to FIG. 1, the front portion of the garment 10 of the present invention is shown wherein leg portions 17 and 19 extend below a waistband 12. The garment, for example a jean type of garment as is shown, may be constructed out of rigid non-stretch denim, indigo or colored material for the full front and most of the rear portion. The front of the garment, as shown in FIG. 1, is comprised of the front portion 14 of the waistband 12, left and right leg portions 17 and 19, zipper or button fly portion 18 and pockets 26, 27 and 28. Also shown in FIG. 1 are belt loops 13 and 15 formed on the front portion 14 of waistband 12, a crotch seam 38 beneath said zipper or button fly portion 18, as well as a button type closure 37 for closing said waistband. However, various type closures may be used to close the waistband, such as hook and clasp, draw-string, or snap-type closures. The garment shown in the figures is a standard five pocket jean but of course any variation of pant construction is well within the teaching herein and the particular construction shown in the figures is not meant to limit the scope of the present invention or claims.

As is typical in construction of jeans, a stitch seam may extend along the length of the left and right leg 17 and 19, the seams indicated by 31 and 30. These seams allow the garment to be pieced together from separate elements.

The fabric of this portion of the jean construction may consist of 100% cotton, for example, or any ounce denim, indigo or color as well as any ounce twill, sateen weaves, broken twills, canvas and other fabrics may be utilized.

Figure 2:
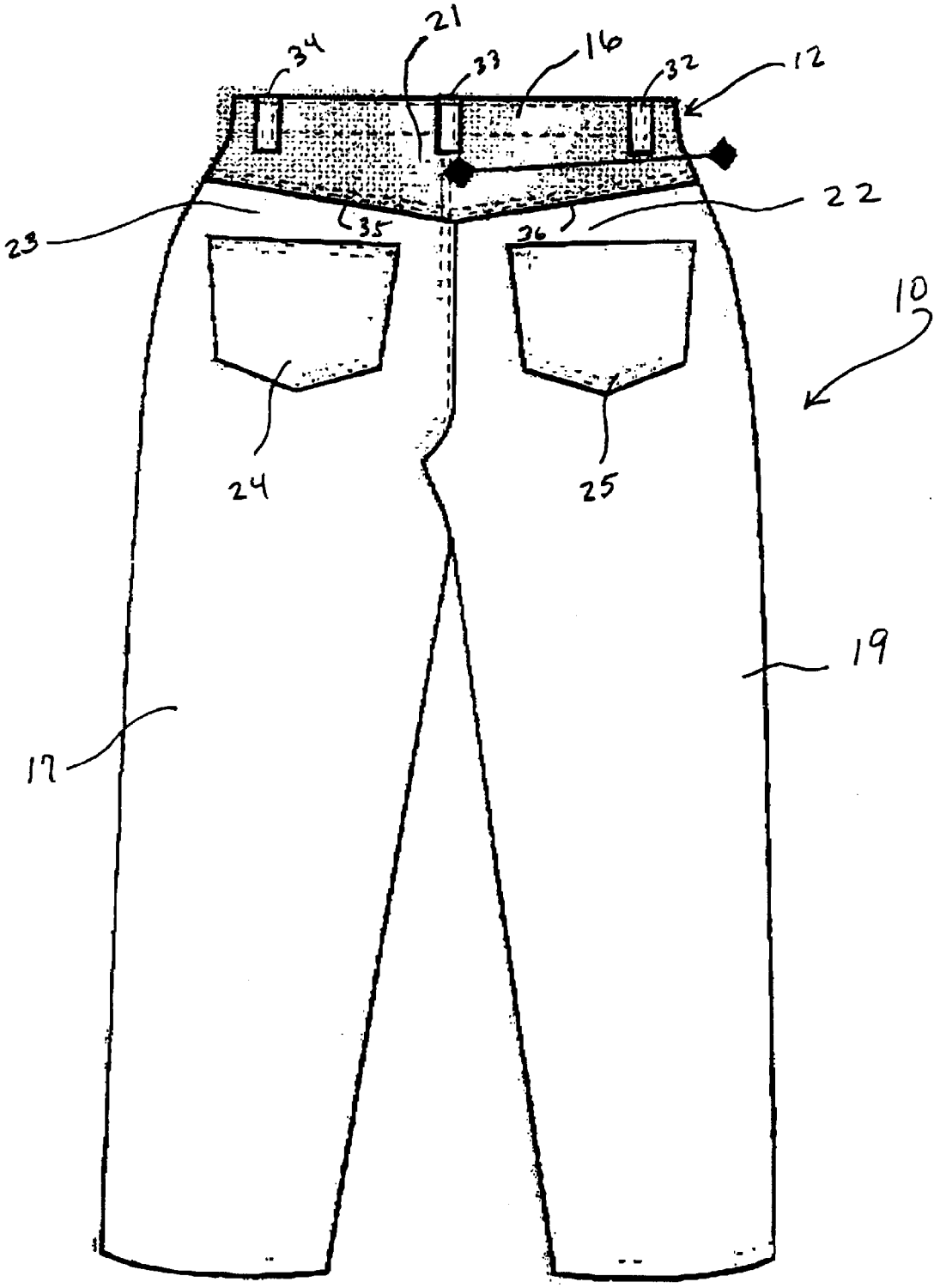
FIG. 2 is a rear view of the garment shown in FIG. 1.

Turning to FIG. 2, the rear portion of the garment 10 of the present invention is shown wherein pockets 24 and 25 are also visible as well as the rear portion of legs 17 and 19 and the seat portion 22 and 23 of each upper leg section. Also shown in FIG. 2 is the rear section 16 of waistband 12 which has affixed thereto additional belt loops 32, 33 and 34. Directly below the rear portion 16 of waistband 12 is the yoke area 21 of the pant seat which is slightly triangular in shape. The border area 35 and 36 between the yoke 21 and seat portions 22 and 23 are stitch seams connecting the yoke to the remaining portion of the pant 10. Thus, the yoke may be comprised of different material than the remaining portion of the pant.

Figure 3:
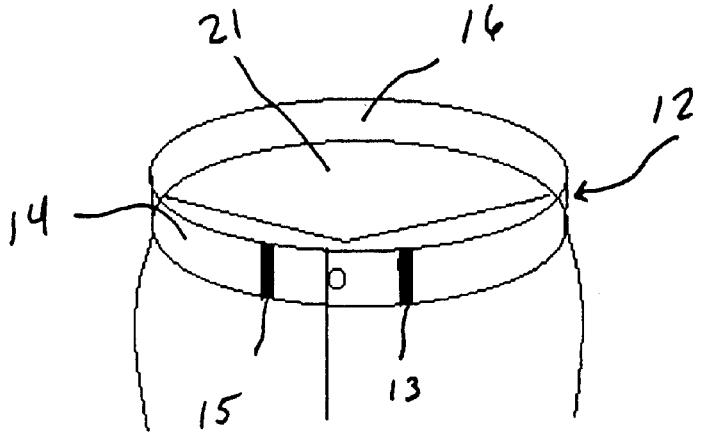
FIG. 3 is a partial top perspective view of the pant garment of the present invention shown in FIG. 1 wherein the yoke and waistband are shown; and, FIG. 4 is a rear view of a short pants garment, wherein the construction of the present invention may also be applied.

The present invention incorporates, as is shown in FIG. 2 and in FIG. 3, a separate material in the yoke 21 and the rear portion of the waistband 16. Instead of utilizing the standard denim or other fabric set forth above, a stretchable material may be used in these particular areas. The waistband 12 of the present invention may thus be a dual construction waistband with the front portion 14 made of a different, standard non-stretch rigid material as opposed to the rear section 16. Further, directly below the rear section 16 of waistband 12 is found the yoke 21 which may also be constructed of a stretchable material. Further, this stretchable material found in the yoke 21 and rear section 16 of the waistband may be constructed of stretch fabrication of the same color and appearance as the remaining portion of the garment. Thus, these sections, namely yoke 21 and rear section 16 of the waistband may be made of a cotton and, for example, elastic or some other stretchable material such as LYCRA, spandex, or durastan. This combination may consist of an 80% to 99% cotton, polyester, nylon, rayon (viscose), or TENCEL (lyocel) and a 20% to 1% LYCRA, or other stretchable material content, or a blend content of stretch and non-stretch materials. Possible examples of these blends include 85% Cotton / 10% Polyester / 5% Spandex or 65% TENCEL / 32% Cotton /3% LYCRA. Preferably the garment has a content of 97% Cotton and 3% LYCRA.

As shown in FIG. 2, multiple belt loops 32, 33, and 34 may be provided on the rear section 16 of the waistband 12. These loops 32, 33 and 34 may be constructed of the standard rigid non-stretch material and sewn directly onto the stretch material described herein.

Figure 4:
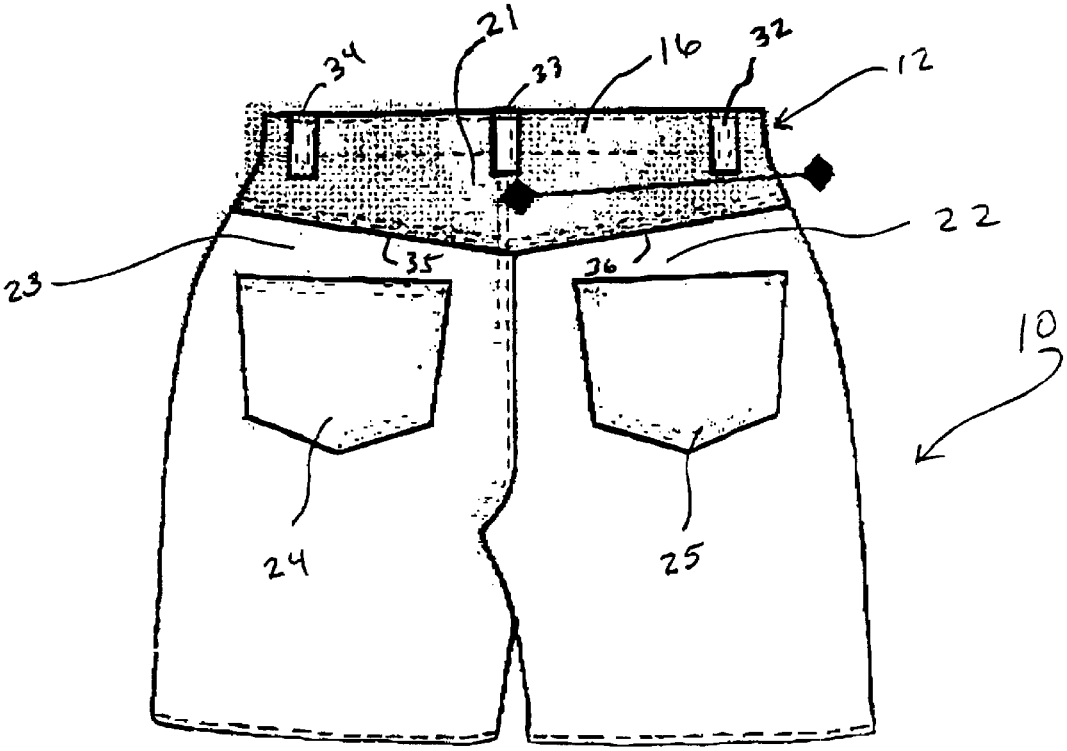

FIG. 4 shows that the invention, as applied to long pants, may also be applied to short pants, also known as "shorts".

By providing a stretchable material which is visually indistinguishable from the remaining portion of the garment and which has the stretchable material placed in the rear waistband and the yoke, the garment will have an elasticity in the rear portion thereof without any visible construction change. The use of a stretch material in this particular area gives the garment a comfort level higher than a regular jean or pant garment yet makes it appear to be a regularly constructed jean or pant garment.

As mentioned above, the pant garment 10 of the present invention has multiple seam areas thus requiring separate areas of the pant to be stitched or sewn together. In utilizing the stretchable material described above, it is preferable to separately cut the back yoke and rear section of the waistband from the stretch material and subsequently assemble these pieces with the remainder of the garment. Thus, seam area 35 and 36 delineates the normal fabric line and the stretch fabric line. Further, the stretch material should preferably be pre-rinsed before cutting the pieces from it. One skilled in the art will appreciate that failure to pre-rinse the stretch material, prior to attaching it to rigid denim, will cause the rigid denim to create undesirable puckers when washed due to the different shrink rates between the materials.

To pre-rinse the stretch material, the stretch fabric is cut in 5 yard cuts which helps prevent roping. Roping is a situation where the material twists in the washer thus leaving streaks of unwashed material which have not been exposed to water. Generally, one-half of the capacity of a washer is filled with fabric. For example a 400-pound capacity washer may be filled with only 200 pounds of fabric in addition to enough water for a 400-pound load, thus helping to prevent roping. Also during the pre-rinse, waxes and resins, which are used to weave the fabric, are removed in a process called desizing.

Temperature and timing variables are also maintained during the pre-rinse of stretch fabric. During this process the temperature of the water is preferably maintained at 160° F. and steam may be added to the washer when the temperature falls below this value. In order to loosen the fabric and make tumbler rotation easier, lubricating enzyme may be added to the washer, during filling, for 150 seconds and softener may be added for 230 seconds. The wash consists of 4 minutes of forward tumbler, 4 minutes of backward tumbler, 2 minutes of forward tumbler, 8 minutes of drain, and an approximate running time of nearly 26 minutes.

After assembly of the stretch material into the pant 10 with the un-washed rigid material, the entire garment 10 will be put through the regular washing procedures as needed under a wash column.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

I claim:

1. A pants garment comprising:

a waistband having a front portion and a rear portion;

left and right leg portions depending from said waistband;

a seat portion above said left and right leg portions and below said rear portion of said waistband;

a yoke area positioned below said rear section of said waistband and above said seat portion;

wherein said yoke is made of a stretchable material and wherein only said rear portion of said waistband is made of said stretchable material.

2. The garment of claim 1 further comprising a seam between said yoke and said seat portion.

3. The garment of claim 1 wherein said stretchable material is comprised of between 80 to 99 percent of a first material and between 1 to 20 percent stretchable material.

4. The garment of claim 3 wherein said first material may be a combination of materials.

5. The garment of claim 4 wherein said first material may be selected from the group of cotton, polyester, nylon, rayon or spandex or a combination thereof.

6. The garment of claim 4 wherein said stretchable material may be spandex.

7. A pants garment comprising:

a waistband having a front portion and a rear portion;

left and right leg portions depending from said waistband;

a seat portion above said left and right leg portions and below said rear portion of said waistband;

a yoke area positioned below said rear section of said waistband and above said seat portion;

wherein said yoke and said rear portion of said waistband are made of a stretchable material.

8. A pants garment comprising:

a waistband having a front portion and a rear stretchable portion;

left and right leg portions depending from said waistband;

a seat portion above said left and right leg portions and below said rear portion of said waistband;

a stretchable yoke area positioned below said rear section of said waistband and above said seat portion.

* * * * *

UNITED STATES PATENT AND TRADEMARK OFFICE

CERTIFICATE OF CORRECTION

PATENT NO. : 6,311,333 B1
DATED : November 6, 2001
INVENTOR(S) : Batra

It is certified that error appears in the above-identified patent and that said Letters Patent is hereby corrected as shown below:

Column 4,
Line 32, change "wherein said yoke is made of a stretchable material" to
-- wherein yoke and said waistband are made of a stretchable material --;

Signed and Sealed this

Eighteenth Day of November, 2003

JAMES E. ROGAN
*Director of the United States Patent and Trademark Office*